US011554401B2

(12) United States Patent
Guo et al.

(10) Patent No.: US 11,554,401 B2
(45) Date of Patent: Jan. 17, 2023

(54) ALUMINUM ALLOY WHEEL END FACE CORRECTING EQUIPMENT

(71) Applicant: CITIC Dicastal Co., Ltd., Qinhuangdao (CN)

(72) Inventors: Jiandong Guo, Qinhuangdao (CN); Le Zhang, Qinhuangdao (CN); Yuemei Zang, Qinhuangdao (CN)

(73) Assignee: CITIC Dicastal Co., Ltd., Qlnhuangdao (CN)

( * ) Notice: Subject to any disclaimer, the term of this patent is extended or adjusted under 35 U.S.C. 154(b) by 0 days.

(21) Appl. No.: 16/951,043

(22) Filed: Nov. 18, 2020

(65) Prior Publication Data

US 2021/0154715 A1 May 27, 2021

(30) Foreign Application Priority Data

Nov. 25, 2019 (CN) ..... 201911161774.1

(51) Int. Cl.
*B21D 1/12* (2006.01)
*B21D 3/16* (2006.01)
*B21D 43/08* (2006.01)

(52) U.S. Cl.
CPC ..... *B21D 1/12* (2013.01); *B21D 3/16* (2013.01); *B21D 43/08* (2013.01)

(58) Field of Classification Search
CPC ... B21D 1/00; B21D 1/08; B21D 1/12; B21D 1/14; B21D 3/10; B21D 3/16; B21D 43/08; B21D 43/003; B21D 43/13; B21D 45/02; B21D 45/04; B21D 45/06; B21D 45/08
USPC ..... 72/31.02, 705
See application file for complete search history.

(56) References Cited

FOREIGN PATENT DOCUMENTS

| | | | | |
|---|---|---|---|---|
| CN | 107662120 A | * | 2/2018 | ..... B23Q 3/08 |
| CN | 108372220 A | * | 8/2018 | ..... B21D 22/02 |
| CN | 108555069 A | * | 9/2018 | ..... B23B 5/28 |
| CN | 108655239 A | * | 10/2018 | ..... B21D 22/02 |
| CN | 109226346 A | * | 1/2019 | ..... B21D 1/02 |
| CN | 109396220 A | * | 3/2019 | ..... B21D 3/10 |
| KR | 100235157 B1 | * | 12/1999 | ..... B21D 5/0209 |

* cited by examiner

*Primary Examiner* — Adam J Eiseman
*Assistant Examiner* — Matthew Stephens

(57) ABSTRACT

The present invention discloses a correction equipment for an end face of an aluminum alloy wheel, including a correction device and a transport device, which is configured to transport the aluminum alloy wheel to the correction device. The correction device comprises a rack body, which is provided with an oil cylinder on an upper part, a lower pressing plate on a middle part and a jacking air cylinder on a bottom part, with an output end of the oil cylinder fixedly connected downward to an upper pressing disc and an output end of jacking air cylinder fixedly connected upward to a lifting frame, on which a displacement roller way is provided. The present invention satisfies the need for an end face correction for an aluminum alloy wheel while having significant, stable and reliable characteristics.

5 Claims, 4 Drawing Sheets

ALUMINUM ALLOY WHEEL END FACE CORRECTING EQUIPMENT

TECHNICAL FIELD

The invention relates to the technical field of aluminum alloy wheel manufacturing, in particular, to a correction equipment for an end face of an aluminum alloy wheel.

BACKGROUND

An aluminum alloy wheel is manufactured according to the process flow of smelting-casting-heat treating-machining-spraying and packaging. During heat treatment of an aluminum alloy wheel, deformation of an aluminum alloy wheel blank will happen due to changes in its internal microstructure, resulting in the release of internal and external stresses. Patterns of deformation are varied, such as wave deformation at the end face, roundness deformation as a whole, local distortion, and so forth. Whichever pattern of deformation will have an impact on the subsequent machining. As an example of deformation an end face, excessive deformation of the end face will lead to misalignment and misclamping phenomena during clamping, resulting in quality defects such as "misalignment", "dynamic balance hyper-difference", "non-uniform appearance", "non-machining" during machining, because the positioning and clamping of machining of the aluminum alloy wheel depends on the end face of the blank.

SUMMARY

In view of this, the purpose of the present invention is to provide a correction equipment for an end face of an aluminum alloy wheel, which enables correction of the aluminum alloy wheel end face.

In order to achieve the purpose, a technical solution of the invention is realized as follows:

A correction equipment for an end face of an aluminum alloy wheel comprises a transport device and a correction device, wherein an aluminum alloy wheel is able to be transported onto the correction device by the transport device.

The correction device comprises a rack body provided with an oil cylinder in the upper part, a lower pressing plate in the middle part, and a jacking air cylinder in the bottom part, wherein an upper pressing disc is fixedly connected downwards to an output end of the oil cylinder, a lifting frame is fixedly connected upwards to an output end of the jacking air cylinder, and a displacement roller way is provided on the lifting frame.

In some embodiments, a groove is provided on the lower pressing plate that cooperates with the lifting frame and displacement roller way, the jacking air cylinder is configured to move the lifting frame up and down so as to transport and place the aluminum alloy onto the lower pressing plate.

In some embodiments, the delivery device comprises a roller way rack on which a conveying roller way and a conveying motor are provided, with an output end of the conveying motor being connected to the conveying roller way.

In some embodiments, the output end of the conveying motor is connected to the conveying roller way via a chain.

In some embodiments, a displacement motor is also provided on the lifting frame, with an output of the displacement motor being connected to the displacement roller way.

In some embodiments, the output of the displacement motor is connected to the displacement roller way by a chain.

Compared with the prior art, the correction equipment for the end face of the aluminum alloy wheel according to the invention has the following advantages:

The present invention satisfies the need for the correction equipment for the end face of the aluminum alloy wheel while having significant, stable and reliable characteristics.

BRIEF DESCRIPTION OF FIGURES

The accompanying drawings, which are included as a part of the invention to provide a further understanding of the invention, and schematic embodiments of the invention together with the description are used to explain the invention and do not constitute any unsuitable limitation of the invention. In the drawings.

DESCRIPTION OF REFERENCE NUMERALS

Figure 1:
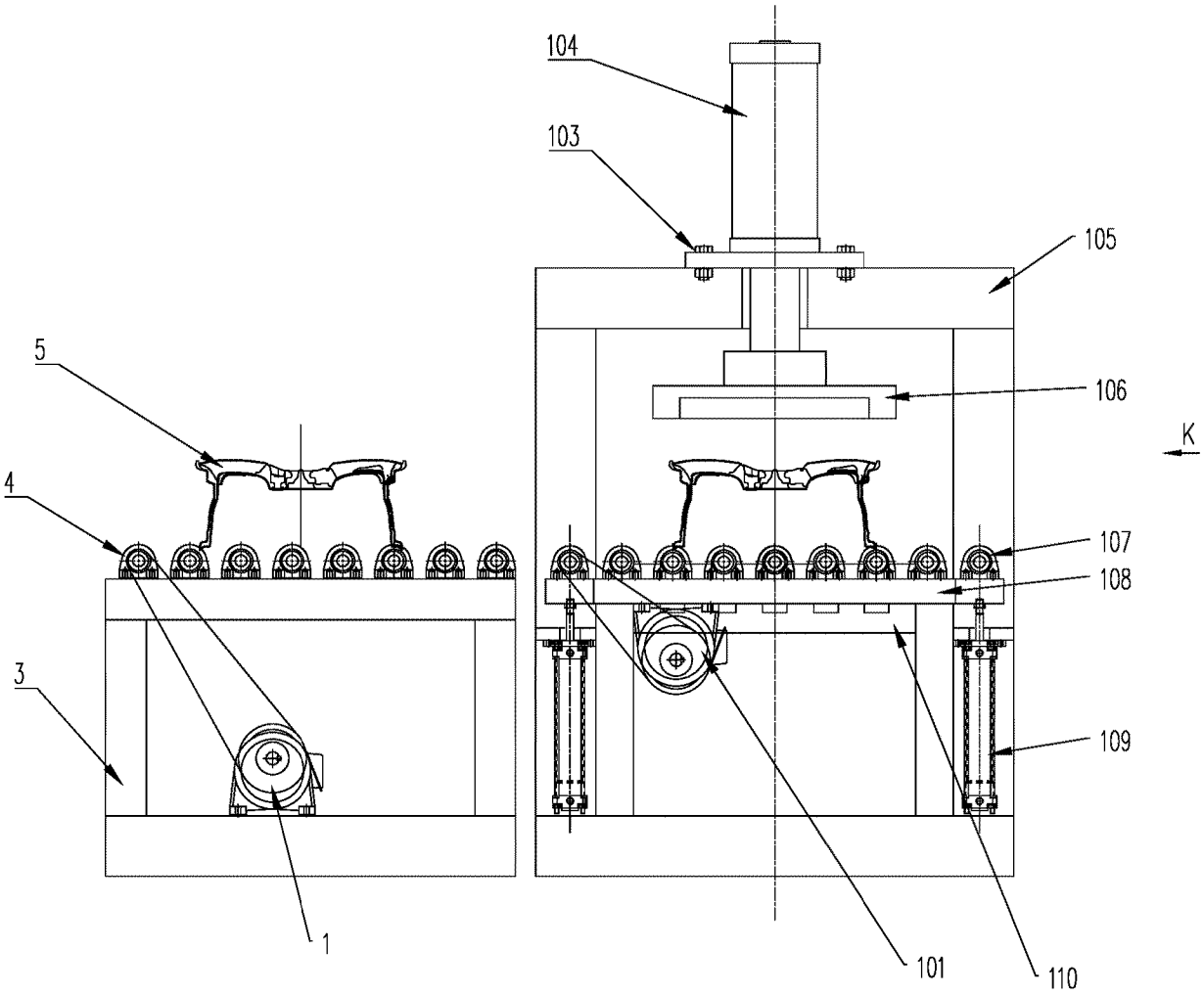
FIG. 1 is a front view of a correction equipment for an end face of an aluminum alloy wheel of the present invention.
Figure 2:
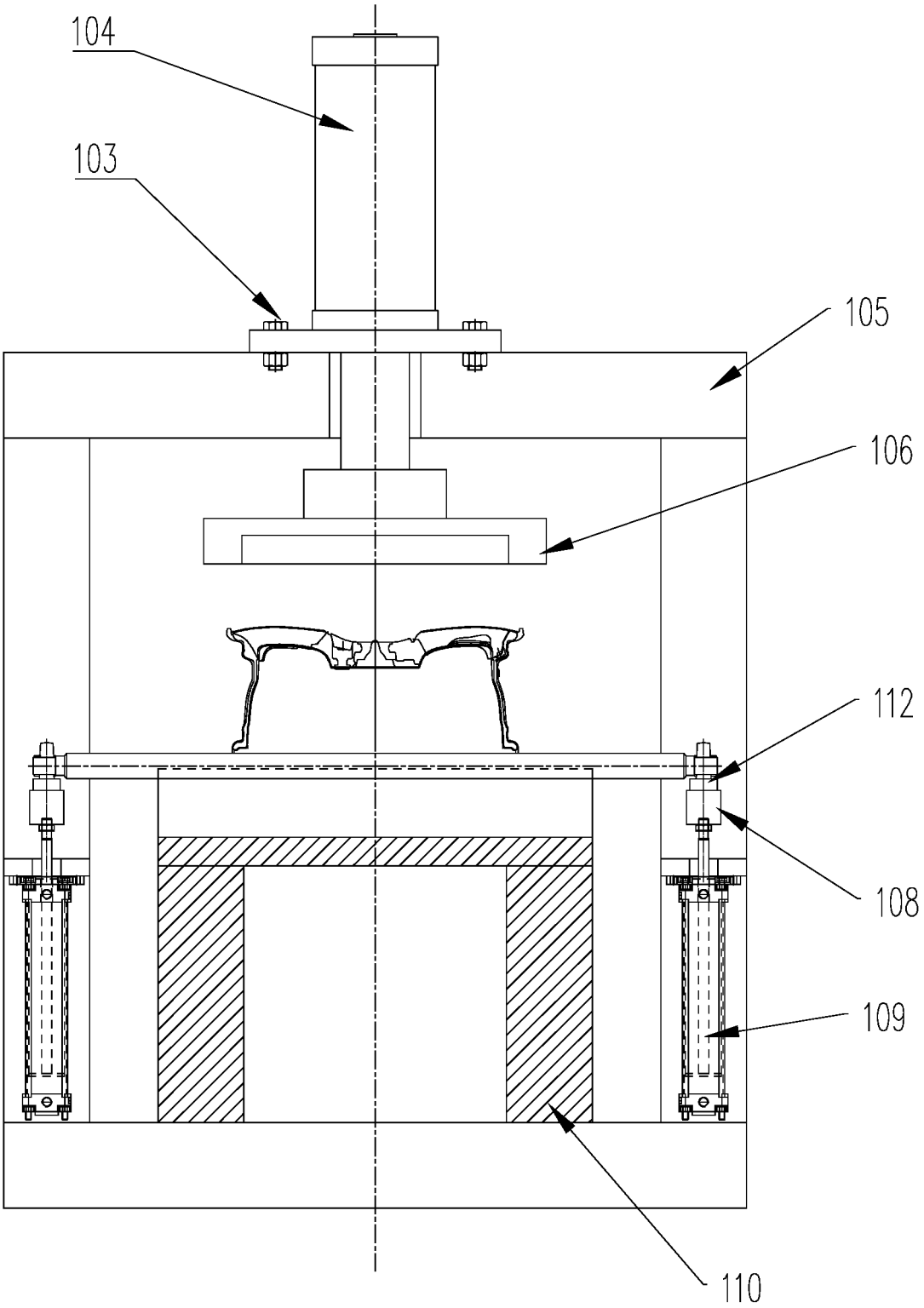
FIG. 2 is a schematic view in K direction of a correction equipment of an end face of an aluminum alloy wheel of the present invention.
Figure 3:
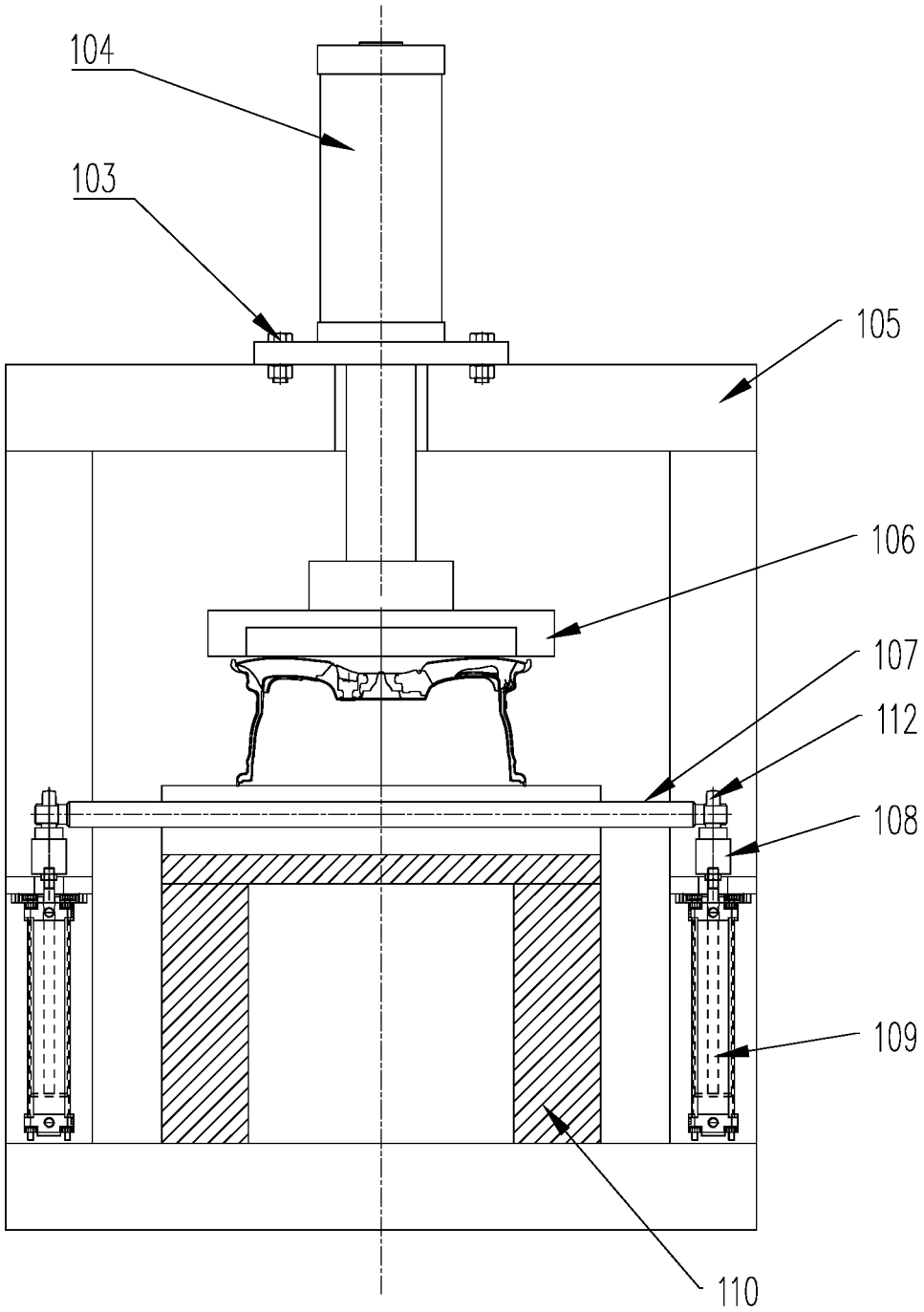
FIG. 3 is a schematic view of a correction equipment for an end face of an aluminum alloy wheel of the present invention in correction status.

1—conveying motor, 3—roller way rack, 4—conveying roller way, 5—wheel, 101—displacement motor, 103—bolt, 104—oil cylinder, 105—rack body, 106—upper pressing disc, 107—displacement roller way, 108—lifting frame, 109—jacking air cylinder, 110—lower pressing plate, and 112—bearing seat

DETAILED DESCRIPTION

It should be noted that embodiments of the present disclosure and features of the embodiments may be combined with one another without conflict.

The technical solution of the present disclosure will be described clearly and completely hereinafter with reference to the accompanying drawings and in combination with embodiments, and obviously, the embodiments described are only a part of embodiments of the present disclosure, and are not all of embodiments thereof. Based on the embodiments of the present disclosure, all other embodiments obtained by a person with ordinary skill in the art without involving any inventive effort fall within the protection scope of the present disclosure.

A correction equipment for an end face of an aluminum alloy wheel of an embodiment of the present invention is described below in conjunction with the embodiment and with reference to FIG. 1-4.

A correction equipment for an end face of aluminum alloy wheel comprises a transport device and a correction device. The transport device comprises a roller way rack 3, conveying motor 1 mounted on the roller way rack 3, a chain, and a conveying roller way 4, wherein conveying motor 1 moves the conveying roller way 4 by means of the chain to run and complete a task of transporting the wheel 5. The correction device comprises an oil cylinder 104, a rack body 105, an upper pressing disc 106, a lower pressing plate 110, a displacement motor 101, a chain, a lifting frame 108, a displacement roller way 107, a bearing seat 112, and a jacking air cylinder 109, wherein the oil cylinder 104 is mounted above the rack body 105 by means of a bolt 103, and a piston rod of the oil cylinder 104 is coupled with the upper pressing disc 106, the jacking air cylinder 109 is mounted on the rack body 105 and capable of driving the lifting frame 108 up and down, the displacement motor 101 and the bearing seat 112 are mounted on the lifting frame 108, the displacement motor 101 drives the displacement roller way 107 to rotate by means of a chain, and the lower pressing plate is mounted on the rack body 105.

In some embodiments, an aluminum alloy wheel 5 is firstly transported forward through the conveying roller way 4 driven by a conveying motor 1, a chain, and a conveying roller way 4.

At this time, the jacking air cylinder 109 in the correction device brings the lifting frame 108, the displacement roller way 107 in a raised status, the displacement motor 101 drives the displacement roller way 107 to rotate via the chain, and the aluminum alloy wheel is naturally sent to a working area of the correction device.

Figure 4:
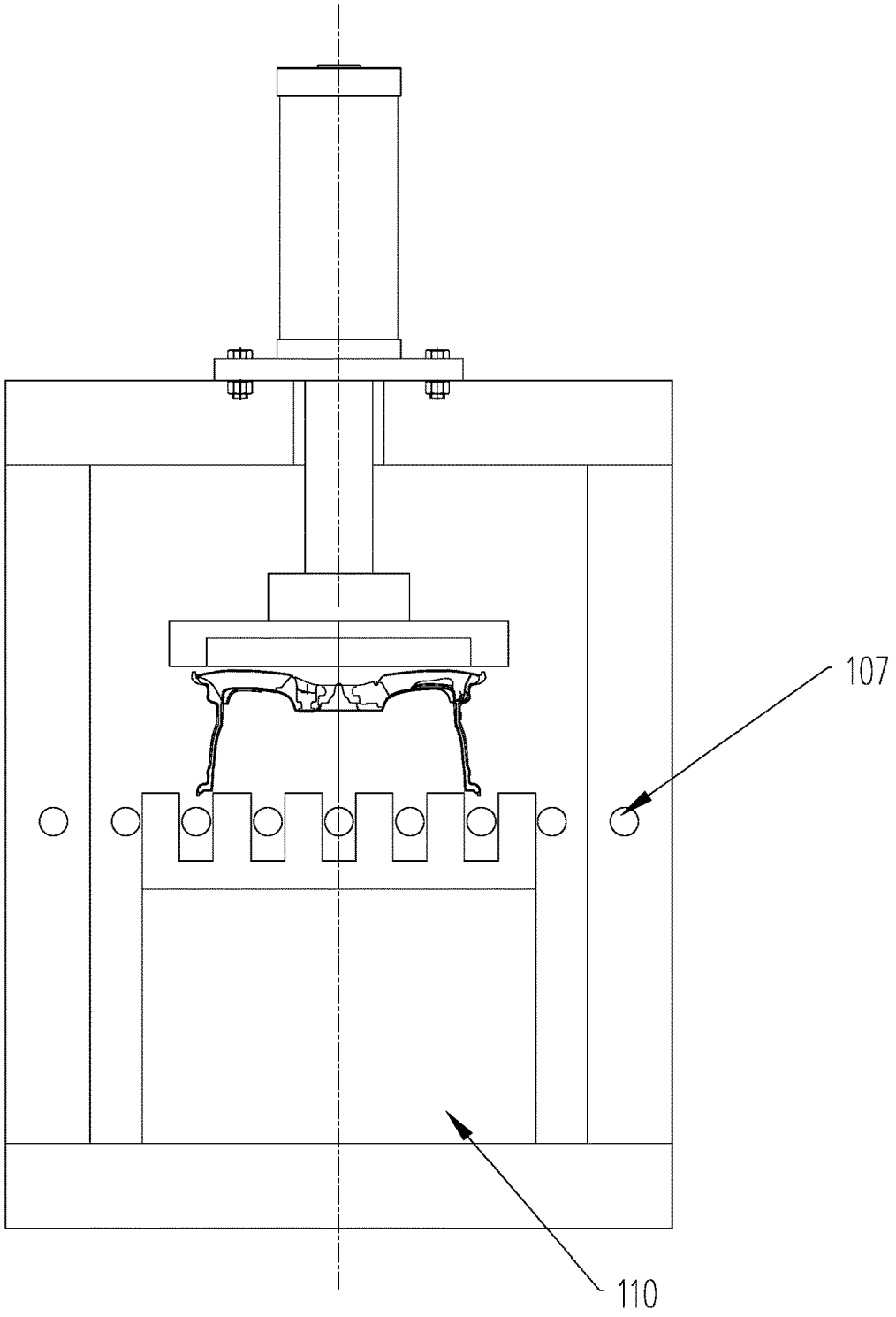
FIG. 4 is a left view of the FIG. 3

Then, the jacking air cylinder 109 of the correction device brings the lifting frame 108 and the displacement roller way 107 to go down. Finally, because the lower pressing plate 110 is provided with grooves, the displacement roller way 107 is brought to go down into the grooves of the lower pressing plate 110 and the aluminum alloy wheel is placed on the lower pressing plate 110 (FIG. 4).

At this point, the oil cylinder 104 drives the upper pressing disc 106 to press downward, as a result, completing work of correction for the face of the aluminum alloy wheel.

Compared with the prior art, the correction equipment for the end face of the aluminum alloy wheel of the present invention has the following advantages:

The present invention satisfies the need for correction for the end face of the aluminum alloy wheel while having significant, stable and reliable characteristics.

In the description of the invention, it needs to be understood that the orientation or position relationship indicated by the terms "center", "longitudinal", "transverse", "front", "back", "left", "right", "vertical", "horizontal", "top", "bottom", "inside" and "outside" are based on the orientation or position relationship shown in the drawings, which is only for the convenience of describing the invention and simplifying the description, rather than indicating or implying that the device or element in question must have a specific orientation, be constructed and operated for a specific orientation, and therefore should not be understood as a restriction on the protection contents of the present invention.

In addition, the terms "first" and "second" are used only for the purpose of description and cannot be understood as indicating or implying relative importance or implicitly indicating the number of technical features indicated. Thus, the features defined as "first" and "second" may explicitly or implicitly include one or more of the features. In the description of the present invention, "multiple" means at least two, such as two, three, etc., unless otherwise specifically defined.

In the present invention, unless otherwise specified and defined, the terms "installation", "connection", "connecting", "fixation" and other terms shall be understood in a broad sense. For example, they can be fixed connection, detachable connection, or integration; they can be mechanical connection, electrical connection or mutual communication; they can be directly connected or indirectly connected through an intermediate media, and can be the internal connection of two components or the interaction between two elements. For those of ordinary skill in the art, the specific meaning of the above terms in the invention can be understood according to the specific situation.

The above is only about better embodiments of the invention, and is not used to limit the invention. Any modification, equivalent replacement, improvement, etc. made within the spirit and principle of the invention shall be included in the protection scope of the invention.

What is claimed is:

1. A correction equipment for an end face of an aluminum alloy wheel, comprising:

a transport device and a correction device, wherein the transport device is configured to transport the aluminum alloy wheel to the correction device; and wherein the correction device comprises a rack body, which is provided with an oil cylinder on an upper part, a lower pressing plate on a middle part and a jacking air cylinder on a bottom part, with an output end extending downward from the oil cylinder fixedly connected to an upper pressing disc, a lifting frame fixedly connected to an output end extending upward from the jacking air cylinder, and a displacement roller way provided on the lifting frame, wherein the lower pressing plate includes grooves configured to receive the lifting frame and the displacement roller way, and the jacking air cylinder is configured to drive the lifting frame to move up so as to transport the aluminum alloy wheel and to move down so as to move down the displacement roller way into the grooves to place the aluminum alloy wheel on the lower pressing plate.

2. The correction equipment for the end face of the aluminum alloy wheel according to claim 1, wherein the transport device comprises a roller way rack, on which a conveying roller way and a conveying motor are arranged, with an output end of the conveying motor connected to the conveying roller way.

3. The correction equipment for the end face of the aluminum alloy wheel according to claim 2, wherein the output end of the conveying motor is connected with the conveying roller way through a chain.

4. The correction equipment for the end face of the aluminum alloy wheel according to claim 1, wherein a displacement motor is further provided on the lifting frame, and an output end of the displacement motor is connected to the displacement roller way.

5. The correction equipment of the end face for the aluminum alloy wheel according to claim 4, wherein the output end of the displacement motor is connected with the displacement roller way through a chain.

* * * * *